US006863427B1

(12) United States Patent
Albou

(10) Patent No.: US 6,863,427 B1
(45) Date of Patent: Mar. 8, 2005

(54) MOTOR VEHICLE HEADLAMP OF THE ELLIPTICAL TYPE CAPABLE OF EMITTING A CUT-OFF BEAM WITH IMPROVED PHOTOMETRY

(75) Inventor: Pierre Albou, Paris (FR)

(73) Assignee: Valeo Vision, Bobigny Cedex (FR)

( * ) Notice: Subject to any disclaimer, the term of this patent is extended or adjusted under 35 U.S.C. 154(b) by 0 days.

(21) Appl. No.: 09/501,069

(22) Filed: Feb. 9, 2000

(30) Foreign Application Priority Data

Feb. 9, 1999 (FR) ..... 99 01495

(51) Int. Cl.[7] ..... F21V 7/00

(52) U.S. Cl. ..... 362/518; 362/487; 362/507; 362/517; 362/543; 362/346; 362/245

(58) Field of Search ..... 362/518, 487, 362/507, 517, 543, 346, 245, 247

(56) References Cited

U.S. PATENT DOCUMENTS

| | | | | |
|---|---|---|---|---|
| 4,517,630 A | * | 5/1985 | Dieffenbach et al. | 362/509 |
| 5,285,362 A | * | 2/1994 | Sakata | 362/263 |
| 5,636,917 A | | 6/1997 | Furami et al. | 362/538 |
| 6,152,589 A | * | 11/2000 | Kawaguchi et al. | 362/518 |
| 6,155,702 A | * | 12/2000 | Blusseau et al. | 362/520 |
| 6,244,731 B1 | * | 6/2001 | Koiko et al. | 362/297 |

FOREIGN PATENT DOCUMENTS

| | | |
|---|---|---|
| EP | 0 254 746 | 2/1988 |
| FR | 2 552 528 | 3/1985 |
| FR | 2704044 | 10/1994 |

OTHER PUBLICATIONS

Patent Abstracts of Japan, vol. 014, No. 006(M–916), Jan. 9, 1989 and JP 01 255103A (Koito Mfg Co Ltd) Oct. 12, 1989.

French Search Report No. 15 Sep. 1999.

* cited by examiner

*Primary Examiner*—Stephen Husar
*Assistant Examiner*—Anabel Ton
(74) *Attorney, Agent, or Firm*—Morgan & Finnegan, LLP

(57) ABSTRACT

A motor vehicle headlamp comprises a source, a mirror possessing first and second focal regions, and a converging lens. The source is located in the first focal region and the lens possesses a focus situated in the second focal region. The mirror and the lens have axes which are essentially coincident defining an optical axis of the headlamp, and the headlamp further includes a mask located in the region of the focus of the lens, in order to project a beam an upper cut-off of which is defined by said mask. Finally, the mirror concentrates the light, in the vertical direction, towards a vertical focusing baseline extending substantially horizontally and transversely to the optical axis and passing close to the focus of the lens. The mirror has at least one corrected vertical focusing area able to concentrate the light, in the vertical direction, towards vertical focusing locuses remote from said vertical focusing line in the axial direction, in order thus to increase the thickness of the light reflected by said area.

11 Claims, 4 Drawing Sheets

MOTOR VEHICLE HEADLAMP OF THE ELLIPTICAL TYPE CAPABLE OF EMITTING A CUT-OFF BEAM WITH IMPROVED PHOTOMETRY

FIELD OF THE INVENTION

The present invention relates in a general way to headlamps of the elliptical type for motor vehicles.

BACKGROUND OF THE INVENTION

An elliptical headlamp conventionally comprises a light source such as an incandescent filament or the luminescent arc of a discharge lamp, this source being placed in a first focal region of a mirror so that the light reflected by it is directed towards a second focal region situated in front of the first one. A lens, generally plano-convex, is focused on this second focal region, so as to project the light spot formed in said second focal region onto the road.

This light spot can be modeled, for example with a mask, to form a beam with cut-off as required, such as a dipped beam, an upper edge of this mask defining the profile of this cut-off.

Because of this possibility of forming a sharp cut-off, and because of the excellent recovery by the mirror of the light flux emitted by the source, such headlamps have been used successfully for many years to form dipped European beams with cut-off in a "V" shape.

In contrast, to produce a dipped beam in accordance with the standards in force in the United States of America, relying on a headlamp of the elliptical type poses more difficulty.

This is because one of the specific features of these standards lies in the requirement for a maximum brightness in the axis of the road which is substantially twice as high as in the European standard, whereas the standardized lamps used in the USA (for example of the 9006 standardized type) have a lower brightness (for identical overall flux and diameter) than the European lamps (for example of the standardized H7 or H9 type) since their filament is substantially lengthy.

Under these conditions, it can be understood that a headlamp possessing a conventional mirror in the shape of an axisymmetric ellipsoid will, in the absence of a mask, generate a beam exhibiting, in the vicinity of the optical axis, a central part of relatively great thickness, due to the images of the filament, which are elongated in the vertical direction and which are produced by the areas of the mirror which are situated immediately above and below the lamp, whereas regions of the mirror laterally very far from the lamp will generate lateral parts of the beam, corresponding to small, horizontally elongated, images of the filament, which will exhibit a substantially reduced thickness by comparison with said central part.

It is conventionally sought, however, in order to produce a satisfactory dipped beam, to give the beam, below the cut-off, a thickness which remains substantial over a significant extent in width, this being done particularly so as properly to illuminate the verges of the road.

It is also sought to obtain this result without degrading the concentration spot of the beam, which is directed in the axis of the road or slightly to the right (in the case of traffic driving on the right).

SUMMARY OF THE INVENTION

An object of the present invention is to remedy these limitations of the state of the art, and to generate, with the aid of a specifically designed mirror, a beam which, once partially shaded by a cut-off mask in a way which is known in itself, gives particularly satisfactory illumination.

Hence the present invention relates to a motor vehicle headlamp, comprising a light source, a mirror possessing first and second focal regions, and a converging lens, the source being placed in the first focal region and the lens possessing a focus situated in the second focal region, the mirror and the lens having axes which are essentially coincident defining an optical axis of the headlamp, and the headlamp further including a mask placed in the region of the focus of the lens, in order thus to project a beam an upper cut-off of which is defined by said mask, and the mirror being able to concentrate the light, in the vertical direction, towards a vertical focusing baseline extending substantially horizontally and transversely to the optical axis and passing close to the focus of the lens, wherein the mirror possesses at least one corrected vertical focusing area able to concentrate the light, in the vertical direction, towards vertical focusing locuses remote from said vertical focusing line in the axial direction, in order thus to increase the thickness of the light reflected by said area.

Preferred, but not limiting, aspects of the headlamp according to the invention are as follows:

- two corrected focusing areas are provided, situated on either side of an axial vertical plane.
- said areas are extreme lateral areas of the mirror.
- the or each corrected vertical focusing area possesses a corrected vertical focusing line separate, in the axial direction, from said vertical focusing baseline.
- the mirror further comprises at least one area for vertical offsetting of the light able to generate a radiation which, on average, is offset upwards or downwards with respect to the vertical focusing baseline.
- the headlamp comprises a vertical offsetting area situated in the central region of the mirror and able to offset the light upwards, and two vertical offsetting areas situated on either side of said central region and able to offset the light downwards.
- the or each vertical offsetting area is constructed from sections of axisymmetric ellipsoids a first focus of which is situated above or below the source and a second focus of which is situated on a vertical focusing line associated with said area.
- the first focus of each ellipsoidal section is situated substantially in the vertical to the center of the source.
- the vertical distances between the first focuses of the various ellipsoidal sections and the center of the source vary progressively from one section to the other.
- from the back of the mirror to its lateral edges, said vertical distances pass progressively from a first value corresponding to a first focal position situated below the source to a second value, of opposite sign, corresponding to a first focal position situated above the source.
- in the region of the lateral edges of the mirror, said vertical distance is essentially zero.

Other aspects, objectives and advantages of the present invention will emerge better on reading the following detailed description a preferred embodiment thereof, given by way of non-limiting example and with reference to the attached drawings.

DESCRIPTION OF THE PREFERRED EMBODIMENTS OF THE INVENTION

Figure 1:
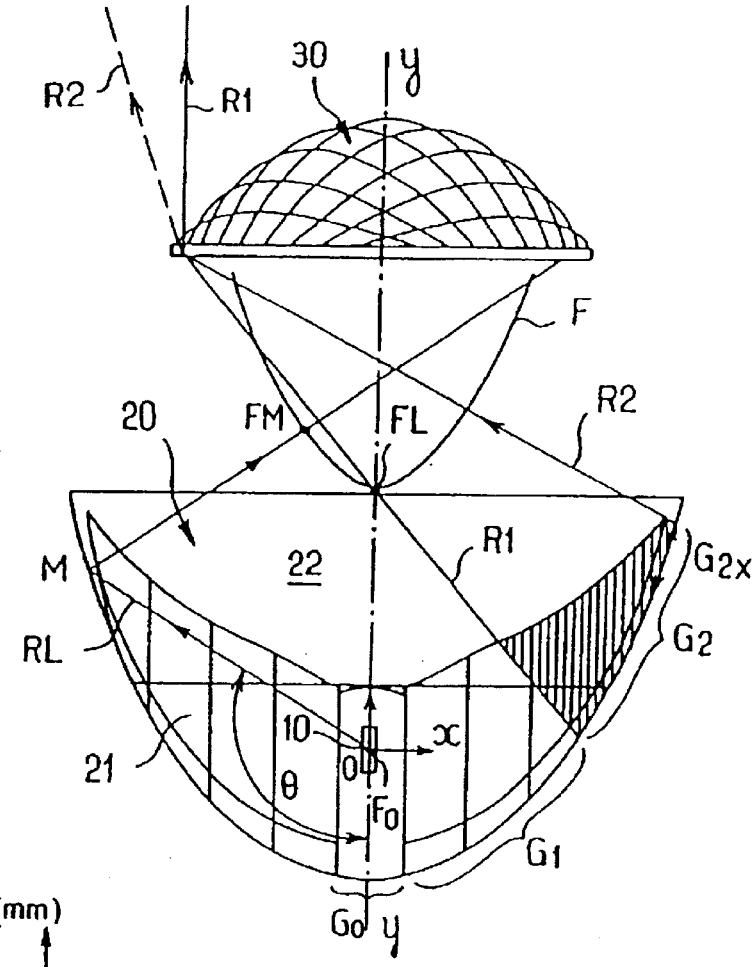
FIG. 1 diagrammatically illustrates the profile of the light beam generated by a headlamp of the elliptical type equipped with an elongated source oriented axially, FIG. 2 graphically illustrates a law of change in the reflection by the mirror as a function of the angle, in projection in the axial horizontal plane, of the light ray emitted by the source.

Referring first of all FIG. 1, a headlamp has been represented partially and diagrammatically, this headlamp comprising a light source 10, in this instance the filament of an incandescent lamp (or in a variant the arc of a discharge lamp), a mirror 20 and a plano-convex lens 30.

A right-angled reference system (0, x, y, z) is defined here, the center 0 of which constitutes a reference focus F0 of the mirror, in which the 0x direction is horizontal and perpendicular to the general direction of emission of the light, in which the 0y direction defines this general direction of emission or optical axis, and in which the 0z direction is vertical.

The mirror 20, with axis y—y, is of the ellipsoidal type, and possesses a usable reflecting surface 21 and upper and lower cheeks 22.

The usable surface possesses a first focal region (namely the reference focus F0) in which the source 10 is situated, and a second focal region situated further forward than the focus F1 on the y—y axis, in which is concentrated the radiation output by the source 10 after reflection on the mirror. In the present example, this mirror is produced in accordance with the principles described in the document FR-A-2 704 044 in the name of the Applicant, to which reference will be made for all the details of its construction, such that the second focal region consists of a vertical focusing line F which, in this instance, extends symmetrically on either side of the optical axis y—y and with a curved shape the concavity of which is directed outwards. This vertical focusing line is the set of the convergence locuses, in vertical planes, of the rays emitted by vertical slices of the mirror and here is located substantially within the tangential focal surface of the lens 30.

In order particularly to limit the overall depth of the headlamp, it is advantageous to position the focusing line F situated close to the front edge 23 of the mirror 20, as illustrated.

As for the lens 30, it possesses an axial focus FL, as has been indicated, a tangential focal surface which passes substantially through the line F, its focus FL thus being situated substantially at the intersection of the focusing line F and of the optical axis y—y, so as to project onto the road the image of the light spot formed in this region.

In accordance with the teachings of FR-A-2 704 044, the mirror is designed in particular in such a way that all the light rays (RL) emitted towards the mirror from the reference point F0 and contained in a vertical plane forming an angle θ with respect to the axial vertical plane y0z are, after reflection, concentrated at a defined place (point FM) of the curve F, and the mirror can be designed in such a way as to obtain laws of progression of the locus of the point FM as a function of the value of θ which are of absolutely any sort. This is obtained by arranging for the cross section of the mirror in the axial vertical plane of angle θ to be identical to the cross section, in the same plane, of an axisymmetric ellipsoid with focuses F0 and FM.

It will be understood here that, by varying these laws, it is possible to model the light spot in the region of the focus of the lens 30, and hence the photometry of the projected beam. In particular, it is possible, for a given angle θ and hence for a given average size of the images of the source, to choose a point FM situated either on the focus FL, or situated laterally, on one side or the other, spaced away from it.

In order to give the projected beam its range, it is necessary to generate a high intensity in the axis of the road. The lens 30, though, projects into the axis of the road only the rays which pass through its focus FL. Hence, in the mirror, areas are defined which are capable of reflecting the rays in such a way that, on the one hand, they pass through the focus FL, that is to say through the intersection of the curve F and of the y—y axis, and that, on the other hand, they encounter the entry face of the lens 30, and other areas for which the reflected rays which would pass through the focus FL would not encounter the entry face of the lens, and would therefore be lost. These other areas are therefore designed in such a way as to cause the light to converge on locuses of the curve F such that these rays encounter the entry face of the lens 30.

In FIG. 1, for the right-hand half of the mirror, areas G0 and G1 have been plotted, these areas belonging to the first category, and the area G2 which belongs to the second category. Corresponding areas exist in the left-hand half of the mirror, this being produced symmetrically with respect to the plane y0z. In FIG. 1 are also plotted examples of rays R1 and R2 which are reflected by the inner and outer edge areas, respectively, of this area G2. The ray R1 passes again through the focus FL (this makes it possible to ensure continuity of the join between the areas G1 and G2) and encounters the lens in the vicinity of its opposite edge, while the ray R2 encounters the lens in this same region, crossing the curve F a long way from the point FL.

If this area G2 is examined, it will be understood that it produces images of the source 10 which are at the same time small and slightly inclined with respect to the horizontal; it will also be understood that the lens 30 projects these images at infinity with more or less significant horizontal deviations.

As for the area G0, it is located at the back of the mirror 20. It will be understood that it produces images of the source which are essentially vertical and of large size.

If the rays corresponding to these images are sent back to the focus FL, then the beam projected will, because of the accumulation of such images in the axis of the road, exhibit a very great thickness, called "flame" of light, which will strongly illuminate the road very close to the vehicle, which is unacceptable for visual comfort since vision in the far distance is then greatly degraded.

Hence, according to a preferred characteristic of the mirror according to the invention, the area G0 is designed so that at least a substantial part of the radiation which it reflects passes some distance away from the focus FL as it is propagated. In that way, a part of the large vertical images is displaced laterally, away from the main illumination field of the headlamp, so as not to disturb vision in the far distance.

The respective widths of the areas G0 and G1 are chosen as a compromise between a substantial width for the area G0 which contributes to spacing away the large vertical images or images slightly inclined with respect to the vertical, and a substantial width for the areas G1, which contributes to giving the beam its range in the axis.

Figure 2:
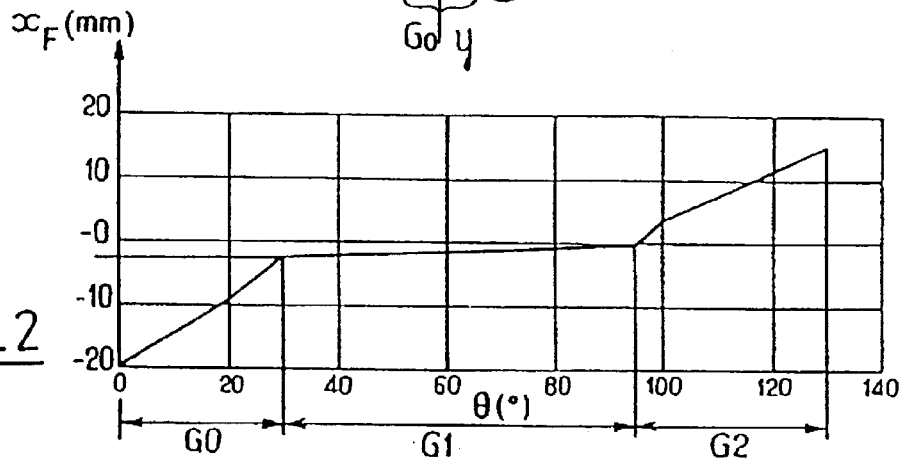

FIG. 2 is a curve illustrating an example of the light distribution achieved in accordance with the invention. This curve gives the setting $X_F$ of the intersection of the light reflected with the curve F, as a function of the angle θ of the ray emitted from the reference point 0 with respect to the reference direction 0y directed towards the back of the mirror (θ=0).

Figure 3:
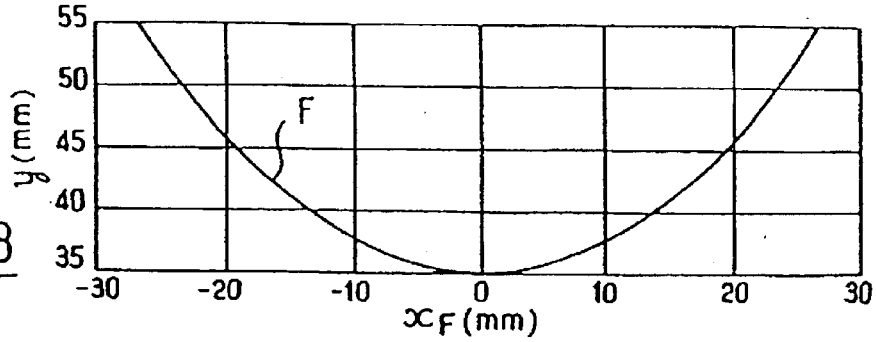
FIG. 3 illustrates the profile of a vertical focusing baseline specific to the mirror of the headlamp.

FIG. 3 illustrates the profile of this curve F, in the form $Y_F$=f ($X_F$).

It is seen in FIG. 2 that, as regards the area G0, the setting $X_F$ varies progressively from −20 mm to about −2 mm, for θ varying from 0° to 30°, this angle of 30° here being the site of the boundary between the areas G0 and G1.

In this way, the images emitted by the back of the filament will be found to be very much displaced laterally with respect to the optical axis, and progressively less and less displaced in proportion as the angle θ increases.

In the area G1, which is covered by θ angles varying between 300° and about 940°, the setting $X_F$ varies progressively from −2 mm to 0 mm, which means that the whole of the radiation reflected by this area passes onto or very close to the focus FL of the lens, so as consequently to be projected in the axis of the road or very slightly inclined with respect to this axis.

Finally the area G2, which here covers the angles lying between 94° and 130°, reflects the radiation over $X_F$ settings varying progressively from 0 to 15 mm, this progression, in conjunction with the abovementioned angular range, being determined so that all the rays reflected actually encounter the entry face of the lens 30.

Figure 4:
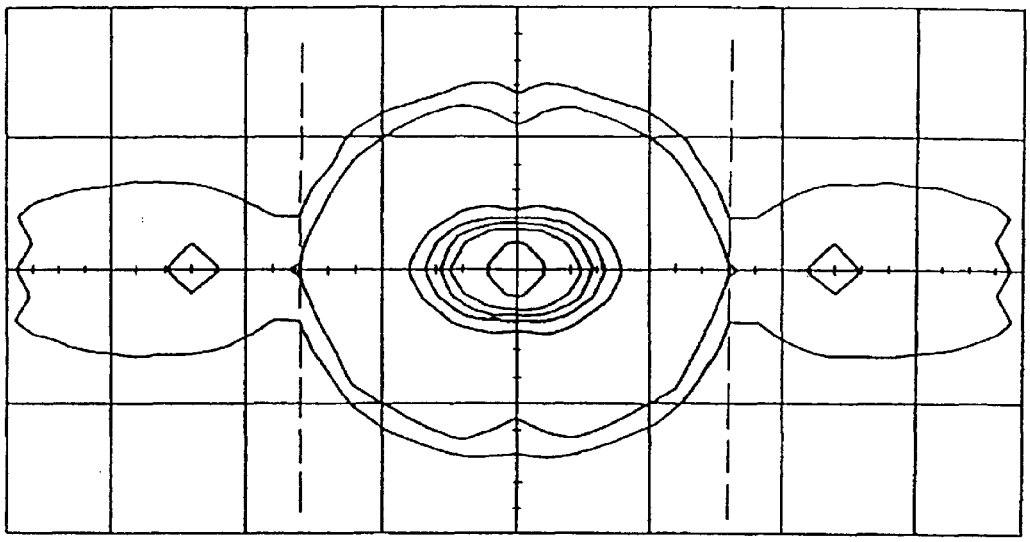
FIG. 4 illustrates the profile of a light beam obtained with the mirror having the properties illustrated in FIGS. 2 and 3.

The profile of the beam projected onto the road by the lens 30 with such a mirror is illustrated in FIG. 4 by a set of isocandela curves. A good point of concentration is observed in the axis, but a beam thickness which, on the one hand, is excessive as regards the axis of the road, and, which, in contrast, is insufficient towards the sides.

Hence such a beam cannot serve as a correct basis for producing, in a way which is perfectly familiar, with the aid of a mask placed in the vicinity of the focal plane PF, a beam with cut-off such as a dipped beam. A description will now be given of the approach which makes it possible to obtain a beam the thickness of which below the cut-off can be well controlled, while varying within acceptable limits between the center and the left and right edges of the beam.

According to a first aspect of this approach, the mirror is designed so that certain areas of the mirror carry out vertical focusing of the light not on the line F, but at a distance from it.

Figure 5:
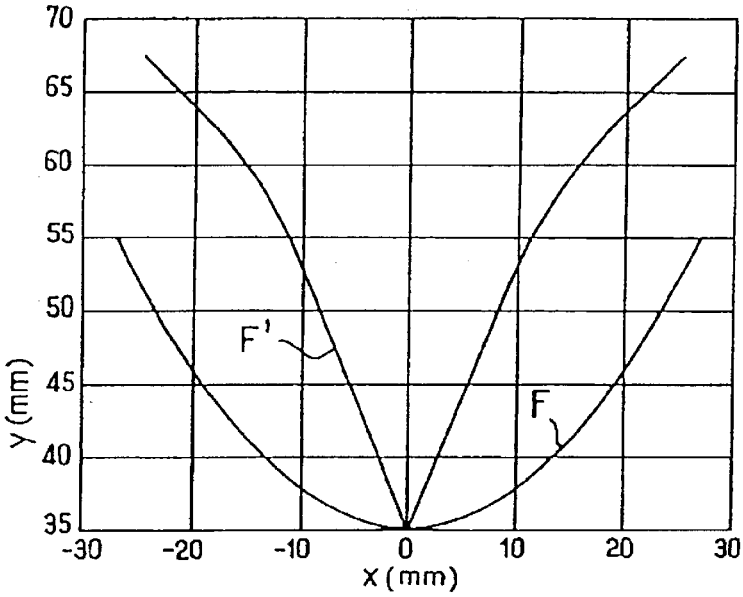
FIG. 5 illustrates the profile of a focusing line used for certain areas of the mirror, FIG. 6 diagrammatically illustrates the contours of the light beam obtained by using the focusing illustrated in FIG. 7.

Hence, FIG. 5 illustrates, in addition to the baseline F, a line F' which touches the curve F in the region of the focus FL but which then moves away from it rapidly, exhibiting inverse curves on either side of the optical axis.

This line F' is preferably used for the construction of the areas G2 of the mirror, whereas the areas G0 and G1 are still constructed on the basis of the line F.

In that way, the radiation reflected by the areas G2 will be characterized by a vertical convergence which will be located at a greater or lesser distance from the tangential focal surface of the lens (depending on the shape of the line F'), and it will be understood that this causes an increase in the thickness of the beam in the regions thereof to which these G2 areas primarily contribute (namely its areas which are laterally farthest away, in the example given in FIGS. 1 to 4).

Figure 6:
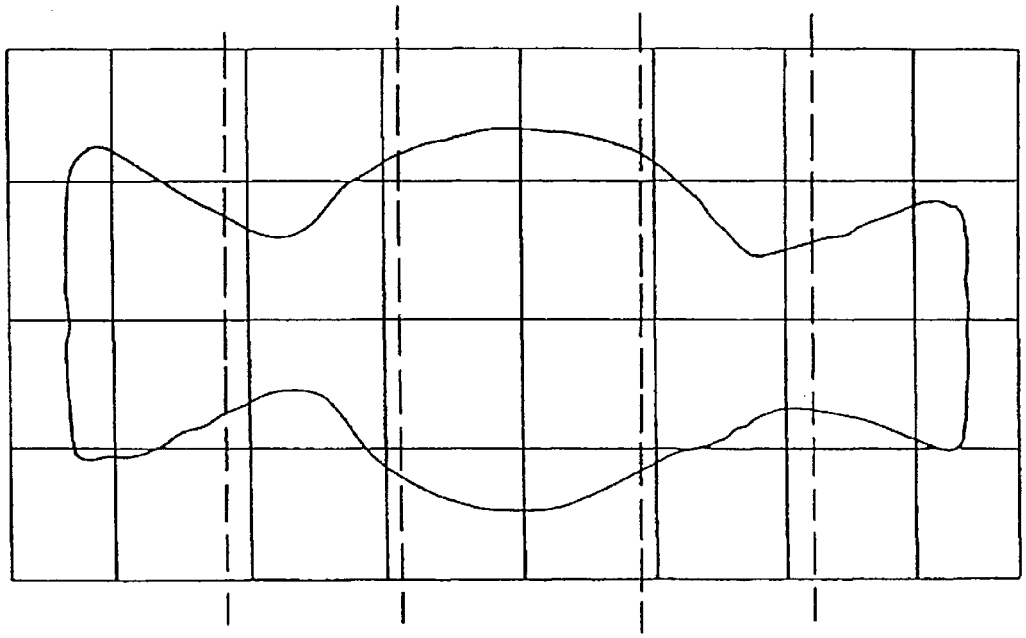

The new profile of the beam is given diagrammatically in FIG. 6, and it is noted that there is a gain in thickness in these lateral areas.

However FIG. 6 also shows that, in the lower region of the beam, hollows persist in the region of which the light does not come low enough down to form an entirely satisfactory cut-off beam. It will be noted that these hollows correspond principally to the regions of the G1 areas which, on the one hand, generate relatively small images of the source and which, on the other hand, concentrate the light vertically at points of the line F which are at an average spacing from its center FL.

Hence, according to another aspect of the approach according to the invention, the design of the mirror is modified in order to attenuate or even eliminate these hollows.

This is achieved here by constructing the corresponding regions of the mirror no longer on the basis of the first reference focus F0 and of a second focus FM situated on the line F, but on the basis of a first reference focus Fd which has been offset vertically with respect to F0, and of the same point FM.

Figure 7:
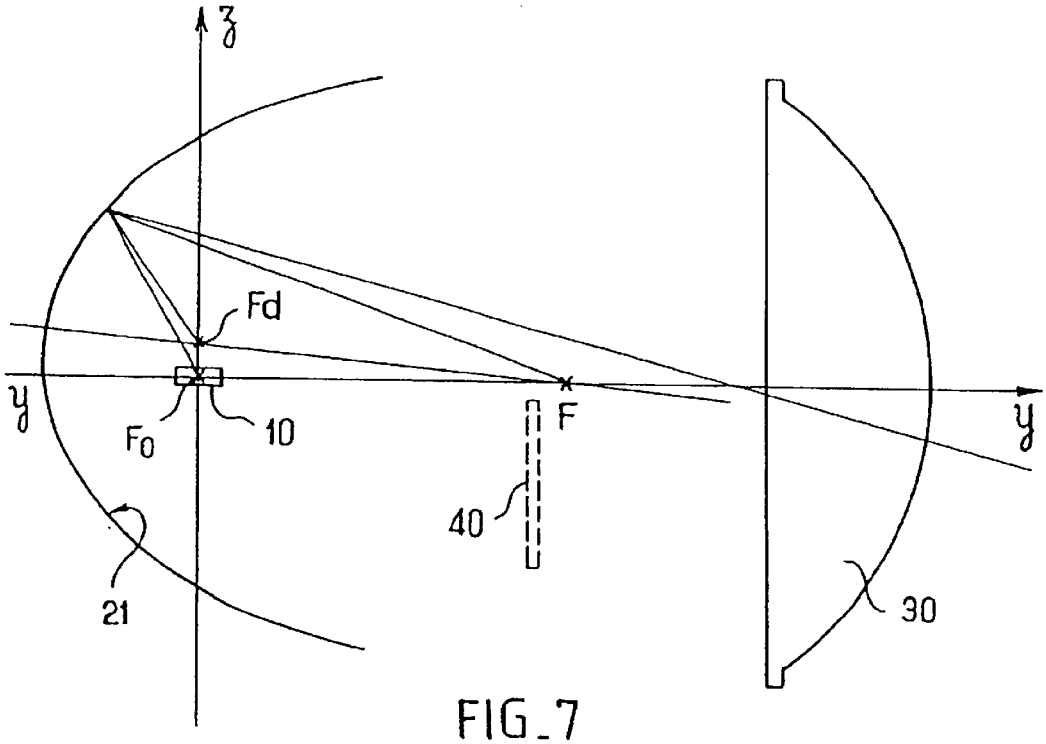
FIG. 7 is a view in projection in the vertical plane, illustrating the construction of a mirror according to the present invention, FIG. 8 diagrammatically illustrates the contours of the light beam obtained by using a mirror designed in accordance with FIG. 7, FIG. 9 graphically illustrates an example of the change in a parameter used in the construction of the mirror represented in FIG. 7.

This principle of construction is illustrated in FIG. 7, in the case in which the focus Fd is located below F0 ($Z_{Fd}$<0). It will be understood that, for any part of the mirror situated behind the transverse vertical plane x0z (that is to say for much the largest part of the solid angle of the light as intercepted by the mirror), any notional ray originating from the reference focus Fd will be reflected towards the line F. In contrast, the rays emitted by the source 10 will be reflected so as to propagate above the line F. Hence, after projection by the lens, these rays will be found to be pushed below the horizon.

Figure 8:
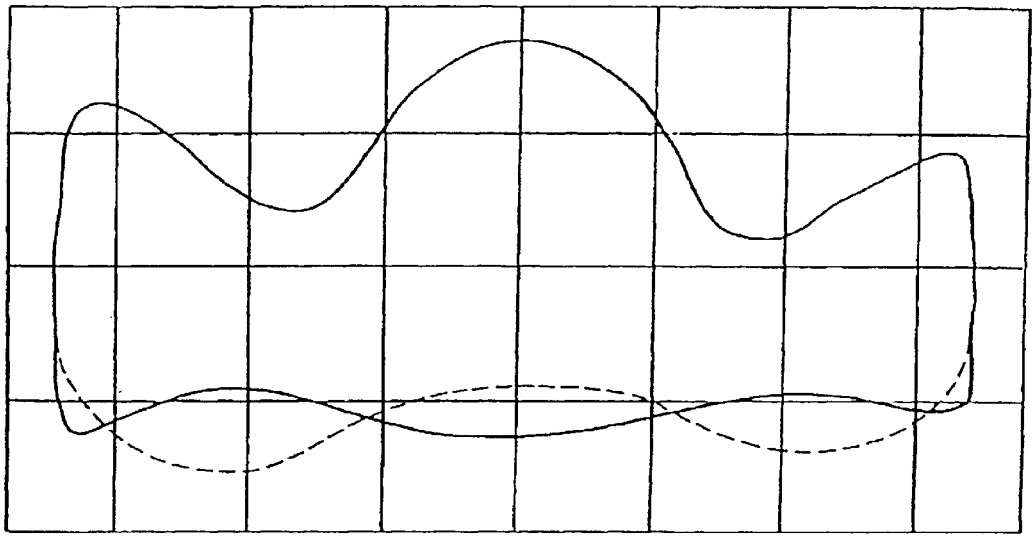

The general profile of the beam thus modified is illustrated in solid lines in FIG. 8. It will be observed here that, by virtue of appropriate parameter setting for the value of $Z_{Fd}$, as a function of θ, it is possible to make fine adjustments to the general contour of the beam in its lower region.

In this regard, it will be noted first of all that, by increasing the value of $Z_{Fd}$, the lowering of the light in the beam projected by the lens is accentuated. It will also be noted that, by choosing positive values of $Z_{Fd}$, it is possible, on the contrary, to raise the light up, and particularly to raise up the large vertical images of the source, which are generated principally by the regions of the mirror situated just above and just below the source, which contribute to forming the downwards bulge of light, in line with the optical axis, in the projected beam.

Hence FIG. 8 also shows, in dotted line, a possible variant of the contour of the projected beam in its lower part.

Figure 9:
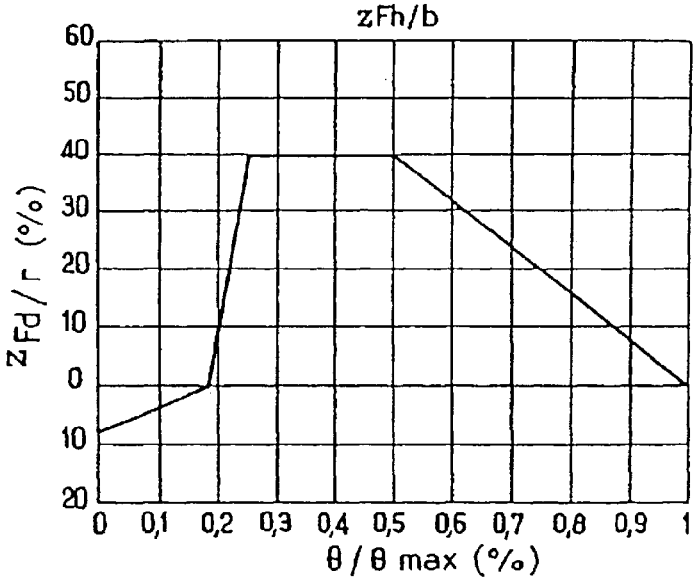

In a preferred way, in order to preserve the continuity of the mirror, it is particularly advantageous to make $Z_{Fd}$ change in a continuous way as a function of the angle θ. FIG. 9 illustrates an example of such a change, expressed in the form of the offset $Z_{Fd}$ relative to the radius r of the source 10 (in %) as a function of the relative change in the angle θ with respect to its maximum value θmax (also in %). It is observed that, starting from the back of the mirror, $Z_{Fd}$ is initially negative, so as to raise up the vertically elongated large images generated by the back region (whether or not these images are initially centered on the point FL). Next, $Z_{Fd}$ increases greatly then is maintained at a constant value over a plateau, which has the effect of causing a lowering of numerous small and medium-sized images of the source. Finally, for the parts of the mirror which are laterally farthest from the back of the mirror, $Z_{Fd}$ again decreases progressively down to a zero value for θ=θmax.

It will be observed here that the controls on $X_F$ and of $Z_{Fd}$ as a function of θ can be governed totally independently of one another.

Figure 10:
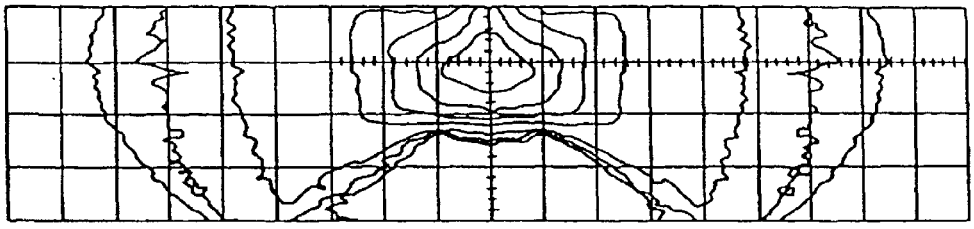
FIGS. 10 illustrates in a more detailed way the profile of the beam obtained with the parameter changing as illustrated in FIG. 9.

The profile of the beam obtained with the parameter setting of $Z_{Fd}$ as illustrated in FIG. 9 is represented in FIG. 10.

The effect of a traditional mask intended to form a cut-off beam, such as an anti-fog or dipped beam, is also illustrated in this figure (such a mask, for its part, being illustrated in dashed line and designated by the reference 40 in FIG. 7), and it is observed that the beam possesses a good point of concentration in the axis of the road, a reasonable thickness in line with this axis, which makes it possible advantageously not to illuminate the road too close to the vehicle, and a greater thickness towards the lateral edges of the beam, which makes it possible to illuminate the verges correctly.

Naturally, and in a way which is perfectly well known, the shape of the edge of the mask determines the profile of the cut-off, in order, for example, to produce an anti-fog beam (flat cut-off), a European dipped beam with a symmetric cut-off in a "V" shape, an American dipped beam with cut-off defined by two straight half-lines offset in height, etc.

The invention applies more particularly to this last type of beam, having regard to the difficulties posed by the characteristics of the source, as mentioned in the introduction. In this regard, with the American regulations not requiring a particularly sharp cut-off, a fuzzy cut-off can be formed by offsetting the mask along the axial direction y—y with respect to the point FL.

What is claimed is:

1. A motor vehicle headlamp, comprising a light source for generating light, a mirror possessing first and second focal regions, and a converging lens, the source being placed in the first focal region and the lens having a focus located in the second focal region, the mirror and the lens having axes which are essentially coincident defining an optical axis of headlamp, and the headlamp further including a mask located in the region of the focus of the lens, in order thus to project a beam having an upper cut-off defined by said mask, and the mirror having at least a first area for concentrating the light in the vertical direction, towards a vertical focusing baseline extending substantially horizontally and transversely to the optical axis and passing close to the focus of the lens, wherein the mirror further comprises at least one corrected vertical focusing area for concentrating the light, in the vertical direction, towards a second vertical focusing baseline separate from said vertical focusing baseline in the axial direction, in order thus to increase a width of the light reflected by said first area along said optical axis.

2. A headlamp as claimed in claim 1, wherein said at least one corrected vertical focusing area comprise two corrected focusing areas, situated on either said of an axial vertical plane.

3. A headlamp as claimed in claim 2, wherein said areas are extreme lateral areas of the mirror.

4. A headlamp as claimed in claim 1, wherein the second vertical focusing line disposed further in the axial direction than said vertical focusing baseline.

5. A headlamp as claimed in claim 1, wherein the mirror further comprises at least one vertical offsetting area for offsetting the light in at least one direction vertically upwards or downwards with respect to the vertical focusing baseline.

6. A headlamp as claimed in claim 5, comprising a vertical offsetting area located in the central region of the mirror and adapted to offset the light upwards, and two vertical offsetting areas located on either side of said central region and adapted to offset the light downwards.

7. A headlamp as claimed in claim 5, wherein the vertical offsetting area is constructed from sections of axisymmetric ellipsoids a first focus of which is situated above or below the source and a second focus of which is situated on a vertical focusing line associated with said vertical offsetting area.

8. A headlamp as claimed in claim 7, wherein the first focus of each ellipsoidal section is situated substantially in the vertical to the center of the source.

9. A headlamp as claimed in claim 8, wherein the vertical distances between the first focuses of the various ellipsoidal sections and the center of the source vary progressively from one section to the other.

10. A headlamp as claimed in claim 9, wherein, from the back of the mirror to its lateral edges, said vertical distances pass progressively from a first value corresponding to a first focal position situated below the source to a second value, of opposite sign, corresponding to a first focal position situated above the source.

11. A headlamp as claimed in claim 10, wherein, in the region of the lateral edges of the mirror, said vertical distance is essentially zero.

* * * * *